United States Patent [19]

Reece

[11] 3,980,482

[45] Sept. 14, 1976

[54] SENSITIZING A THERMOGRAPHIC SILVER HALIDE PHOTOGRAPHIC MATERIAL WITH MONOMERIC AMIDE

[75] Inventor: Jack E. Reece, Willernie, Minn.

[73] Assignee: Minnesota Mining and Manufacturing Company, St. Paul, Minn.

[22] Filed: June 5, 1974

[21] Appl. No.: 476,450

[52] U.S. Cl. ..... 96/114.1; 96/107

[51] Int. Cl.[2] ..... G03C 1/02

[58] Field of Search ..... 96/107, 114.1, 94 R

[56] References Cited

UNITED STATES PATENTS

| | | | |
|---|---|---|---|
| 3,178,296 | 4/1965 | Minsk et al. | 96/107 |
| 3,457,075 | 7/1969 | Morgan et al. | 96/114.1 |
| 3,819,382 | 6/1974 | König | 96/114.1 |

*Primary Examiner*—Won H. Louie, Jr.

*Attorney, Agent, or Firm*—Alexander, Sell, Steldt & DeLaHunt

[57] ABSTRACT

Photosensitive heat-developable dry silver sheet materials, containing organic silver salt and reducing agent and in which a minor portion of the silver salt has been halidized, are given an orders-of-magnitude increase in photographic speed by incorporating an organic sensitizing amide prior to halidizing.

9 Claims, No Drawings

SENSITIZING A THERMOGRAPHIC SILVER HALIDE PHOTOGRAPHIC MATERIAL WITH MONOMERIC AMIDE

This invention relates to light-sensitive heat-developable dry silver coatings and sheet materials and their preparation. In particular the invention relates to improvements in the photographic speed of dry silver coatings as achieved by controlled addition of defined amide sensitizing materials.

U.S. Pat. No. 3,457,075 describes the preparation of dry silver coating compositions containing light-stable organic silver salt, reducing agent, and photosensitive silver halide, the silver halide being formed by halidization of a minor portion of the organic silver salt. Various modifications have been described, see for example U.S. Pat. Nos. 3,589,903, 3,635,719 and 3,667,959; but have resulted in no substantial improvement in photographic sensitivity.

It has now been found possible to achieve substantial increase in photographic speed or sensitivity of dry silver coatings prepared as above described, by incorporating organic sensitizing amides. Surprisingly, a substantial increase in sensitivity is obtained only when the amide is added to the organic silver salt prior to halidization. In a preferred procedure the amide and a small amount of binder are added to the silver salt, well dispersed in a volatile liquid vehicle, followed by addition of the halidizing agent; the last-named and subsequent steps being performed under darkroom conditions. By following this procedure, the speed of the resulting light-sensitive sheet has been increased by as much as two orders of magnitude. More specifically, a sheet has been made as described having a relative speed of approximately 100-150, compared to a sheet made identically except for omission of the amide and having a relative speed of unity.

The speed of the light-sensitive coating is determined as the reciprocal of the exposure required to generate a density of 0.6 greater than base plus fog. Exposure and density are obtained by customary sensitometric procedures. Relative speed is then the ratio of the speed of the sample to that of a control sample.

The effectiveness of various amides differs widely but may easily be determined by a simple test procedure as will be detailed under Example 1 hereinafter. Those amides which in such test show a speed of at least about two relative to a control speed of unity are to be considered as practical sensitizing amides for the purposes of this invention.

Surprisingly, compounds of otherwise similar structure but devoid of the amide function, and which have previously been suggested as useful in enhancing the maximum image density in heat-developable photosensitive coatings, are found to contribute essentially no increase in speed when substituted for the sensitizing amide in the processes of this invention.

The sensitizing amides fall within the structural formulas $R_1CONR_2R_3$, $R_1R_2NCONR_3R_4$, or $(R_1R_2N)_3PO$ wherein the R radicals may be hydrogen or hydrocarbon. The hydrocarbon radical may contain oxygen, nitrogen, or sulfur atoms in such minor proportion as to be substantially the equivalent of hydrocarbon. Two of the R radicals may together represent a divalent hydrocarbon radical. Substituted hydrocarbon radicals wherein the substituent groups are inert with respect to the dry photographic system are likewise to be included. The compounds may contain from one to as many as 25 carbon atoms per amide nitrogen atom, or preferably from one to about twelve carbon atoms per amide nitrogen atom; and the longest carbon chain in any single R radical or divalent R-R radical combination must contain not more than about twelve carbon atoms.

Transparent photosensitive coatings applied to transparent film backings are preferred in performing the sensitometric tests herein described, but translucent or opaque substrates, such for example as paper, and non-transparent subcoatings and photosensitive coatings are likewise useful. The photosensitive silver halide component may be silver bromide, chloride, iodide or a mixture of two or more. Spectrally sensitizing dyes, antifoggants, toning agents, and other additives and modifiers may be incorporated.

In the following illustrative but non-limiting Examples, proportions are given in parts by weight unless otherwise indicated.

EXAMPLE 1

A mixture containing 12.5 g. of silver behenate, 6.6 g. of methyl isobutyl ketone, 21.0 g. of toluene, and 60 g. of methyl ethyl ketone is charged to a stirred reaction vessel. While this mixture is stirred, an amount of the amide compound equimolar to the amount of silver present is added, followed in about five minutes by 1.0 weight per cent (based on the total mixture) of polyvinyl butyral resin.

After an additional five minutes' stirring, 5.6 ml. of a solution prepared by mixing 10 ml. of 48% hydrobromic acid with 78.2 ml. of methanol is added during about 1 minute. After 30 minutes, 0.6 ml. of solution containing 18 g. of mercuric bromide in methanol to 100 ml. is added with stirring followed within five minutes by 7.3 g. of polyvinyl butyral resin.

After a final 5 minutes' stirring, the mixture so obtained is coated on polyester film and dried at 70–90° C. for 4–7 minutes. The dry coating weight is 1.3–1.4 g./sq. ft. The dried film is then overcoated with a solution containing 5.8 g. of methyl ethyl ketone, 1.1 g. of methanol, 0.4 g. of polyvinyl acetate-polyvinyl chloride copolymer, 0.6 g. of a hindered phenol developer (1,1-bis(2-hydroxy-3,5-dimethylphenyl)-3,5,5-trimethylhexane) and 0.12 g. of toner (phthalazinone) and again dried, the added dry coating weight being 0.35 g./sq. ft. The film is exposed sensitometrically using a 6100° K. light source and developed by heating for 30 seconds at 260° F. A summary of the relative speeds of films prepared in this manner with a variety of different amides is given in the following table.

Table 1

| Amide | Rel. Speed |
|---|---|
| none (control sample) | 1 |
| N,N'-diacetyl-2-aminophenyl disulfide | 0.6 |
| succinimide | 0.7 |
| N,N-dimethyl chloroacetamide | 0.8 |
| polyvinylpyrrolidone | 0.8 |
| N-methyl maleimide | 0.8 |
| cyclohexanone | 1.0 |
| N-ethylsuccinimide | 1.0 |
| butyrolactone | 1.0 |
| N,N-diethylurethane | 1.0 |
| p-nitrobenzamide | 1.3 |
| formamide | 1.3 |
| N,N-diphenylacetamide | 2.0 |
| N,N,N',N'-tetramethyl phthalamide | 2.0 |
| 5-methyl-2-pyrrolidinone | 2.1 |
| 1-vinyl-2-pyrrolidinone | 2.1 |
| benzamide | 2.6 |
| acetamide | 2.9 |

Table 1-continued

| Amide | Rel. Speed |
|---|---|
| poly-N,N-dimethylacrylamide | 3.0 |
| p-methoxybenzamide | 5.6 |
| p-chlorobenzamide | 6.5 |
| N,N-dimethylacrylamide | 6.5 |
| N,N-dimethyl lactamide | 6.8 |
| N,N-dimethyl formamide | 6.8 |
| hexamethyl phosphonamide | 7.1 |
| N,N'-diacetylpiperazine | 7.4 |
| N-methylacetamide | 9.1 |
| N,N'-dimethylethyleneurea | 12 |
| N-methylpropionamide | 12 |
| 2-pyrrolidinone | 13 |
| N,N-dimethylbenzamide | 17 |
| hexamethylene formamide | 26 |
| caprolactam | 26 |
| N,N-dimethylacetamide | 40 |
| N,N,N'N'-tetramethylurea | 49 |
| N-acetyl morpholine | 55 |
| 1-methyl-2-pyrrolidinone | 59* |
| N,N-dimethylnicotinamide | 60 |
| 1-methyl-2-piperidone | 66 |
| 1-methyl-2-pyridone | 90 |
| 1-benzyl-2-pyrrolidinone | 132 |

*The value reported for 1-methyl-2-pyrrolidinone is an average of several trials showing a range of relative speeds of 44 to 72.

It may be observed that of the compounds tested, the first nine resulted in no improvement in relative speed as compared with the control sample. The succinimides in particular caused appreciable fog formation and such materials are undesirable. Speeds of about 1.3 to 1.5 relative to a control speed of unity are readily observable; at relative speeds of five to ten, the effect is highly significant; at relative speeds greater than ten, particularly those greater than 50, the products are commercially useful in operations previously inaccessible to the dry silver sheet materials.

EXAMPLE 2

This example illustrates the effect on sensitivity of adding the sensitizing amide at different times in the preparation sequence. The components and amounts of each are as set forth in Example 1, the sole difference being in the step of adding the sensitizer. In each case the amide is 1-methyl-2-pyrrolidinone.

A. The amide is added to the silver soap dispersion just prior to halidization. The relative speed is 72.

B. The amide is added in a final step following addition of the halidizing agents and additional binder resin and shortly prior to coating. The relative speed is 1.6.

C. The amide is added to the silver soap dispersion prior to adding the one per cent of polyvinyl butyral resin. The relative speed is 50.

D. The amide and the one per cent of polyvinyl butyral resin are added simultaneously. The relative speed (for a single test) is 69, i.e., very similar to A and slightly greater than C.

In the foregoing Examples the amide is present in equimolar amount based on the silver soap. Useful results in terms of significantly increased relative speeds are obtained with between one-hundredth and two moles of sensitizing amide per mole of silver soap. Example 3 illustrates the effect of amide concentration on speed, using 1-methyl-2-pyrrolidinone in all cases.

EXAMPLE 3

An iodobromide emulsion similar to that in Example 1 is prepared as follows. To 178 g. portions of a mixture of silver behenate in the solvent system described previously are added mixtures each containing a different amount of the amide and sufficient methyl ethyl ketone to make 10 grams. After 5 minutes' mixing, 1 gram of polyvinyl butyral resin is added and stirring continued. Under safelight conditions the mixture is treated with a mixture containing hydrobromic acid and cadmium iodide prepared immediately before use by combining 5 ml. of a solution containing 5 ml. of 48% hydrobromic acid in 87 ml. of methanol with 1.5 ml. of a solution containing 1.83 g. of cadmium iodide in 100 ml. of methanol.

Stirring is continued 30 minutes after which 0.5 ml. of the mercuric bromide solution described previously is added followed by 12.5 g. of polyvinyl butyral resin. Coatings are prepared as in Example 1 and are overcoated as described previously. Table 2 summarizes the effects of variations in the amount of the amide added initially on the photographic speed of the finished film relative to that of a control film containing none of the amide.

Table 2

| Amount of Amide Added, g. | Mole Ratio Amide/Ag | Relative Speed |
|---|---|---|
| 0 | — | 1.0 |
| 0.015 | .003 | 1.8 |
| 0.036 | .007 | 2.3 |
| 0.053 | .01 | 1.5 |
| 0.107 | .02 | 1.5 |
| 0.30 | .06 | 5.2 |
| 0.51 | .10 | 4.8 |
| 1.0 | .2 | 3.9 |
| 3.0 | .6 | 9.8 |
| 5.0 | 1.0 | 14.1 |

Many of the sensitizing amide materials are per se volatile and might be expected to be removed from the coating during the step of solvent removal. Apparently a considerable proportion, at least of the more volatile materials, is indeed lost. However, it has been found possible to detect at least trace amounts of 1-methyl-2-pyrrolidinone in sheet made with this material even after prolonged heating, using such sophisticated methods of analysis as gas chromatography on a chloroform extract of the coating.

Somewhat comparable sensitizing effects may also be obtained with dimethyl sulfoxide. Thus, addition of this material subsequent to halidization, as in Example 2B, results in a sheet having a relative speed of only 2.2; whereas a relative speed of 52 is achieved by introducing the dimethyl sulfoxide prior to halidization, i.e., as in Example 1. However, this substance decomposes on heating, is moderately hazardous, and is to be avoided in the practice of the invention.

Spectral sensitization of the compositions and coatings of this invention may be accomplished in known manner, i.e., through the incorporation of spectral sensitizing dyes, of which a number of examples have been given in U.S. Pat. No. 3,457,075 previously referred to. The sensitizing amides of the present invention are colorless and do not affect the spectral response of the silver halide other than to increase its apparent native light sensitivity.

Halidization with other sources of halide ions, to produce other photosensitive silver halides or mixtures for specific purposes, is likewise taught in the prior art and may be employed in the practice of this invention; greatest speed is ordinarily obtained with dry silver compositions wherein the photosensitive silver halide catalyst-forming means is a mixture of silver bromide and a minor proportion of silver iodide.

Other variations include, for example, incorporating all components in a single coating, or adding the hindered phenol reducing agent to the first rather than the second coating. In all cases it is essential that the sensitizing amide be added to the silver soap prior to conversion of a portion of the silver content to the photosensitive silver halide.

What is claimed is as follows:

1. In the process of making a light-sensitive heat-developable dry silver sheet material containing (a) photosensitive silver halide catalyst-forming means and (b) heat-sensitive reactant image-forming means including an organic silver salt oxidizing agent and a reducing agent for silver ion, the oxidation reduction reaction of which, to produce a visible change, is accelerated by said catalyst, the improvement comprising: mixing with the organic silver salt, prior to halidization thereof, a spectrally inert sensitizing amide, and thereafter halidizing a minor proportion of said organic silver salt, wherein said sensitizing amide is a monomeric amide having the structure:

$R_1CONR_2R_3$, $R_1R_2NCONR_3R_4$ or $(R_1R_2N)_3PO$ wherein one of the R groups represents hydrogen or a hydrocarbon radical having no more than twelve carbon atoms and the remaining R groups represent monovalent hydrocarbon having no more than twelve carbon atoms or substituted hydrocarbon radicals having no more than twelve carbon atoms or two of said remaining R groups represent a divalent hydrocarbon radical having no more than twelve carbon atoms or hydrocarbonoxy radical having no more than twelve carbon atoms, with the proviso that none of $R_1$, $R_2$, $R_3$, and $R_4$ in the formula $R_1R_2NCONR_3R_4$ may be hydrogen.

2. Process of claim 1 wherein said amide is a 2-pyrrolidinone.

3. Process of claim 1 wherein said amide is a 2-pyridone.

4. Process of claim 1 wherein said amide is a 2-piperidone.

5. Process of claim 1 wherein said amide is a substituted urea of the formula:

$R_1R_2NCONR_3R_4$ wherein $R_1 - R_4$ are as defined above.

6. Process of claim 1 wherein said amide is a tertiary amide.

7. Process of claim 1 wherein the molar ratio of said amide to said salt is between one-hundredth and two.

8. Process of claim 7 wherein said molar ratio is approximately unity.

9. A light-sensitive heat developable dry silver sheet material comprising (a) photosensitive silver halide catalyst forming means and (b) heat-sensitive reactant image-forming means including an organic silver salt oxidizing agent and a reducing agent for silver ion, further comprising a monomeric spectrally inert organic sensitizing amide added prior to halidization of said organic silver salt and having a photographic speed of at least 5 compared to an otherwise identical sheet material free of said amide and wherein the speed is taken as unity, speed being measured by sensitometric exposure to a 6100°K light source and heat development for 30 seconds at 260°F, said sensitizing amide being represented by the formulae:

$R_1CONR_2R_3$, $R_1R_2NCONR_3R_4$ or $(R_1R_2N)_3PO$ wherein one of the R groups represents hydrogen or a hydrocarbon radical having no more than twelve carbon atoms and the remaining R groups represent monovalent hydrocarbon having no more than twelve carbon atoms or substituted hydrocarbon radicals having no more than twelve carbon atoms or two of said remaining R groups represent a divalent hydrocarbon radical having no more than twelve carbon atoms or hydrocarbonoxy radical having no more than twelve carbon atoms, with the proviso that none of $R_1$, $R_2$, $R_3$, and $R_4$ in the formula $R_1R_2NCONR_3R_4$ may be hydrogen.

* * * * *